US005857438A

United States Patent [19]

Barnard

[11] Patent Number: 5,857,438

[45] Date of Patent: Jan. 12, 1999

[54] HYDRAULICALLY OPERATED VARIABLE VALVE CONTROL MECHANISM

[76] Inventor: Daniel Wayne Barnard, 32073 Cattle Way, Coarsegold, Calif. 93614

[21] Appl. No.: 42,176

[22] Filed: Mar. 12, 1998

Related U.S. Application Data

[60] Provisional application No. 60/040,811 Mar. 18, 1997.

[51] Int. Cl.[6] ..... F01L 13/00; F01L 9/02

[52] U.S. Cl. ..... 123/90.16; 123/90.12; 123/90.48

[58] Field of Search ..... 123/90.12, 90.13, 123/90.15, 90.16, 90.48, 90.49, 90.55

[56] References Cited

U.S. PATENT DOCUMENTS

| | | | |
|---|---|---|---|
| 2,636,757 | 4/1953 | Bakane | 123/90.48 |
| 4,231,543 | 11/1980 | Zurner et al. | 123/90.12 |
| 4,324,210 | 4/1982 | Aoyama | 123/90.16 |
| 4,357,917 | 11/1982 | Aoyama | 123/90.16 |
| 4,475,490 | 10/1984 | Oono et al. | 123/90.48 |
| 4,656,976 | 4/1987 | Rhoads | 123/90.12 |
| 5,327,858 | 7/1994 | Hausknecht | 123/90.12 |
| 5,485,813 | 1/1996 | Molitor et al. | 123/90.12 |
| 5,577,468 | 11/1996 | Weber | 123/90.12 |

*Primary Examiner*—Weilun Lo
*Attorney, Agent, or Firm*—Richard A. Ryan

[57] ABSTRACT

A hydraulically operated mechanism which utilizes engine oil as the hydraulic fluid to open and close a cylinder valve is easily installed on a conventional internal combustion engine to improve engine performance over a wide range of operating parameters. A primary assembly has a piston that is actuated by the rotational movement of the cam lobe to pressurize oil inside a tube or hose and deliver pressurized oil to a secondary assembly to push open the valve. The secondary assembly has a secondary piston that utilizes a spring to abut against the valve. The hydraulic variable valve control mechanism optimizes the engine valve event by being self-adjusting and by virtually eliminating valve lash, resulting in improved engine performance, including horsepower, fuel consumption and exhaust emissions, at all ranges of engine speed. The hydraulically operated variable valve control mechanism reduces the amount of moving mechanical components in the conventional internal combustion engine by eliminating the need for the lifter, push rod and rocker arm.

29 Claims, 5 Drawing Sheets

HYDRAULICALLY OPERATED VARIABLE VALVE CONTROL MECHANISM

CROSS-REFERENCE TO RELATED APPLICATIONS

This application claims the benefit of U.S. Provisional Patent Application No. 60/040,811 filed Mar, 18, 1997.

BACKGROUND OF THE INVENTION

1. Field of the Invention

The field of the present invention relates generally to cylinder valve opening mechanisms and, in particular, to cylinder valve opening mechanisms for use in internal combustion engines. More particularly, the present invention relates to cam lobe operated devices which hydraulically control cylinder valves in internal combustion engines to obtain improved operating characteristics, including increased horsepower, reduced fuel consumption and/or improved emissions quality.

2. Background

Internal combustion engines have been and continue to be used in virtually every mode of transportation and for all types of power supply needs throughout the entire world. These engines have been the subject of intensive efforts in the United States and most industrialized countries throughout this century to improve their operating characteristics. Certain of these efforts have been addressed to improving the horsepower, fuel consumption and/or exhaust air quality of these engines. However, until recently, very little advancement has been made in the basic mechanism for operating the cylinder intake and exhaust valves.

The typical internal combustion engine comprises a series of cylinders having pistons and valves. Air and fuel are combined in the piston chamber and ignited by a spark from a spark plug. The fuel and air are fed into the piston chamber through an intake valve and, after combustion, exhaust air is forced out through the exhaust valve. To obtain proper performance of the fuel/air igniting sequence, the valve activating mechanism must open and close the intake and exhaust valves at the proper times. Due to relatively high engine operating speeds, this process happens at a very fast rate.

The valve activating mechanism consists, primarily, of the camshaft, valve lifter, push rod and rocker arm. The valve activation mechanism is driven by the camshaft, which has a series of cams having a cam lobe and cam heel. One end of the valve lifter contacts the cam lobe when the cam rotates under it. The opposite end of the valve lifter contacts the push rod, which contacts one side of the rocker arm. The other side of the rocker arm contacts the valve stem to open and close the valve. As the cam lobe rotates under the lifter, the push rod pushes up one end of the rocker arm, causing it to pivot and push down the valve at the opposite end of the rocker arm, thereby unseating and opening the valve. The rate of valve lift, amount of valve lift and the duration of that lift are commonly referred to as the "valve event." A valve spring below the valve side of the rocker arm encircles the valve stem and applies an upward force to close the valve, along with combustion pressure from inside the piston chamber. The upward force exerted by the push rod must be sufficient to overcome the valve spring force.

The conventional cylinder valve activation mechanism can provide optimum intake and exhaust valve timing over only a limited range of engine speed, measured in revolutions per minute ("RPMs"). Typically, the optimum operation of these valves is set to occur at or near engine speeds that occur at the engine's rated horsepower. At this speed, high volumetric efficiency is achieved by closing the exhaust valve late and opening the intake valve early (referred to as "valve overlap"). Unfortunately, valve settings that provide valve overlap are not well suited to low engine speeds and, as a result, dramatically reduce the volumetric efficiency of the engine. For improved efficiency and to obtain optimum performance at low engine speeds, the valves need to open when the piston is at or near the top or bottom of its cycle.

One way to improve performance for the typical internal combustion engine at low engine speeds is to increase the amount of time the valve lifter does not contact the cam (i.e., increasing the crankshaft rotating degrees relative to the opening of the valves—referred to as "valve lash"). Increasing valve lash shortens the amount of time the valve is open and reduces overlap. Although this improves the operation of the engine at low speeds, excessive valve lash results in undesirable noise, wear and loss of horsepower at higher engine speeds.

3. Related Art

A number of related art devices address the limitations of the mechanical valve activation mechanism of the conventional internal combustion engine. Such devices include U.S. Pat. No. 4,656,976 to Rhoads, U.S. Pat. No. 5,193,494 to Sono, U.S. Pat. No. 5,193,495 to Wood, U.S. Pat. No. 5,195,474 to Urata, U.S. Pat. No. 5,231,959 to Smietana, U.S. Pat. No. 5,673,658 to Allmendinger and U.S. Pat. No. 5,682,846 to Scharnweber. None of these related art devices solve the problems with conventional valve activation mechanisms identified above in the manner solved by the present invention.

Each of the aforementioned patents present devices and mechanisms for internal combustion engines that require significant modification to the typical internal combustion engine or which are otherwise not suitable for obtaining the benefits sought by those in the field. As such, despite the potential benefits to be obtained by improving the valve activation mechanism, the inventions set forth in the aforementioned patents, or derivations thereof, are generally not utilized in present day internal combustion engines. Consequently, a need exists for a hydraulically operated variable valve control mechanism that is compatible with and relatively easy to install in the typical internal combustion engine.

SUMMARY OF THE INVENTION

The mechanism for hydraulically controlling valves of the present invention solves the problems identified above. That is to say, the present invention provides a hydraulically operated variable valve control mechanism that is relatively inexpensive to manufacture, simple to use and has only a few moving parts. In the preferred embodiment, the present invention uses the engine's oil as the hydraulic fluid and, as such, does not require an additional fluid reservoir or hydraulic pump. The reduction in mechanical parts (i.e., the lifter, push rod and rocker arm) and the reduced wear on the remaining parts from the self-lubricating nature of the invention will translate into fewer and less severe mechanical breakdowns over time.

The hydraulically operated variable valve control mechanism of the present invention automatically varies the valve event to be directly proportional to engine speed. As such, the present invention provides correct valve lift and duration at all engine speeds, resulting in increased volumetric efficiency. Depending upon the configuration chosen, this will reduce fuel consumption, increase horsepower and/or improve the air quality of the emissions from the internal combustion engine. The present invention will permit very high engine speeds with less valve spring pressure and higher valve lifts. The present invention will also permit very low engine speeds at efficiencies that cannot be achieved with the typical mechanical valve actuating mechanism.

To utilize the present invention, the valve lifter, push rod and rocker arm of the typical internal combustion engine are removed. The present invention, comprising a dual piston system, is easily installed in place of the removed components. In the preferred embodiment, a primary assembly abuts against and engages a cam on the camshaft and a secondary assembly abuts against and engages the end of the valve. Interconnecting the two piston assemblies is a flow passage having a first end and second end.

The primary assembly of the preferred embodiment comprises the first end of the flow passage, formed in or attached to a primary cylinder, slidably received in an inverted (external) piston. The interior of the inverted piston forms a chamber having a ball bearing seated on a seat inside the chamber and a primary spring disposed between the flow passage or primary cylinder and the ball bearing. In the preferred embodiment, the inverted piston has an external channel and an internal channel with one or more openings interconnecting the two channels. The openings allow oil from the engine's oil lubrication system to flow inside the chamber. The secondary assembly comprises a secondary piston moveably disposed inside a secondary cylinder, which can be the second end of the flow passage. A secondary spring in the secondary cylinder applies a downward force on the secondary piston. In the preferred embodiment, a snubber assembly is used to allow increasing or decreasing the size of the secondary piston and cylinder.

In operation, the cam lobe on the cam rotates under the primary piston to push it upward, thereby compressing the primary spring and pressurizing the fluid in the chamber. The increased pressure forces the secondary piston downward against the end of the valve to compress the valve spring and open the valve to allow fuel/air in (intake valve) or combustion gases out (exhaust valve). After the cam lobe rotates past the primary assembly, the primary piston moves downward to relieve the pressure inside the flow passage and reduce the downward force on the secondary piston, thereby permitting the valve to move in an upward and closing direction towards the valve seat.

Accordingly, the primary objective of the present invention is to provide a cylinder valve control mechanism for internal combustion engines that automatically affords maximum flexibility and advantageous operation over a wide range operating parameters.

It is also an important objective of the present invention to provide a hydraulically operated variable valve control mechanism that is relatively easy to install in and use with conventional internal combustion engines.

It is also an important objective of the present invention to provide a hydraulically operated variable valve control mechanism that automatically varies valve lift and duration as the engine speed increases or decreases.

It is also an important objective of the present invention to provide a valve control mechanism that utilizes engine oil to hydraulically operate the valves and vary the valve event in an internal combustion engine.

Yet another important objective of the present invention is to provide a hydraulically operated variable valve control mechanism that utilizes two piston assemblies and an interconnecting flow passage to obtain improved horsepower and/or gas mileage over a wide range of engine operating conditions.

Yet another important objective of the present invention is to provide a hydraulically operated variable valve control mechanism that is self-bleeding, self-lubricating and self-adjusting.

It is yet another objective of the present invention to provide a valve control mechanism that reduces the amount of mechanical components and mechanical breakdowns.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
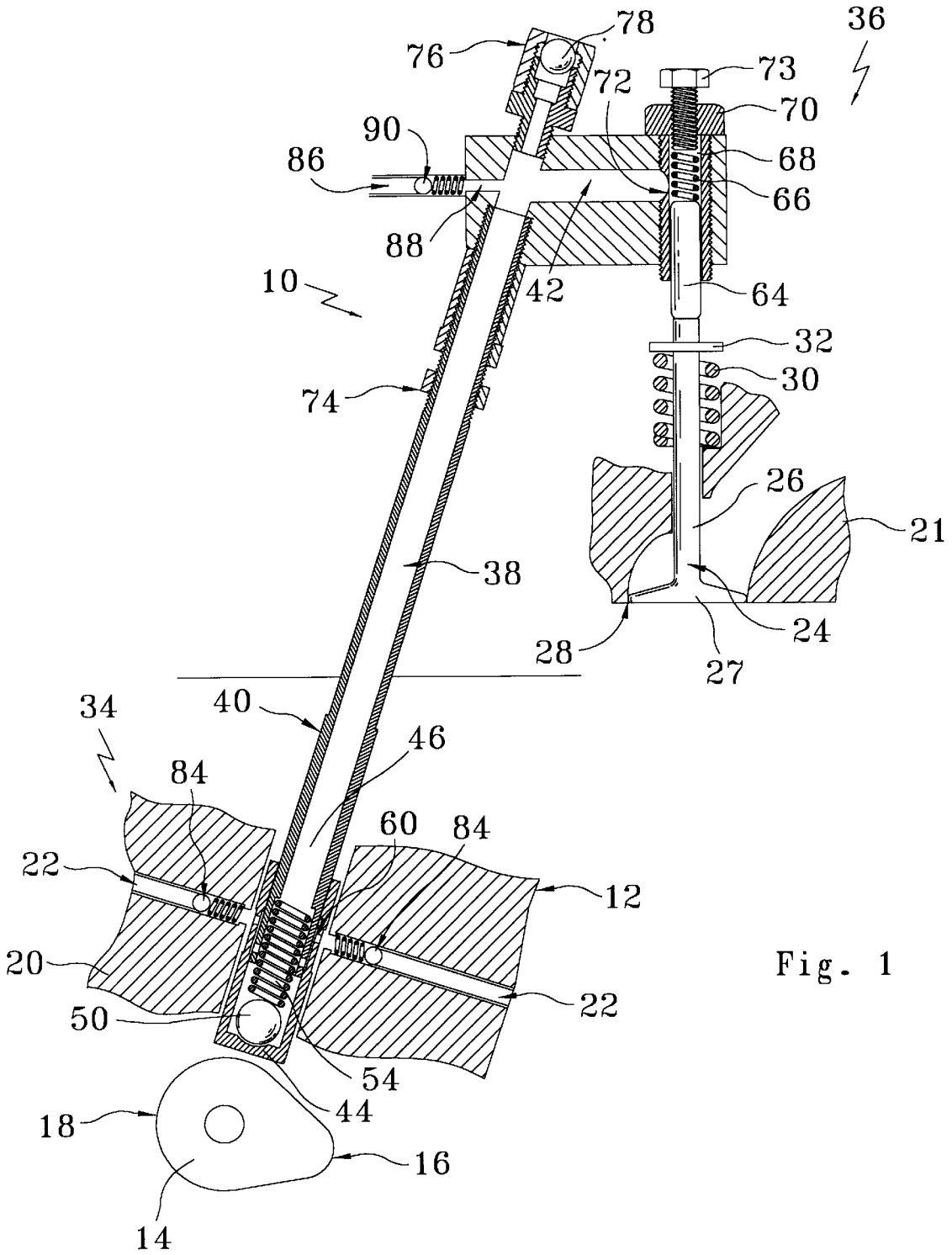
FIG. 1 is a cross-sectional view of a valve control mechanism of the present invention showing the use of various alternative embodiments in conjunction with the preferred embodiment.
Figure 2:
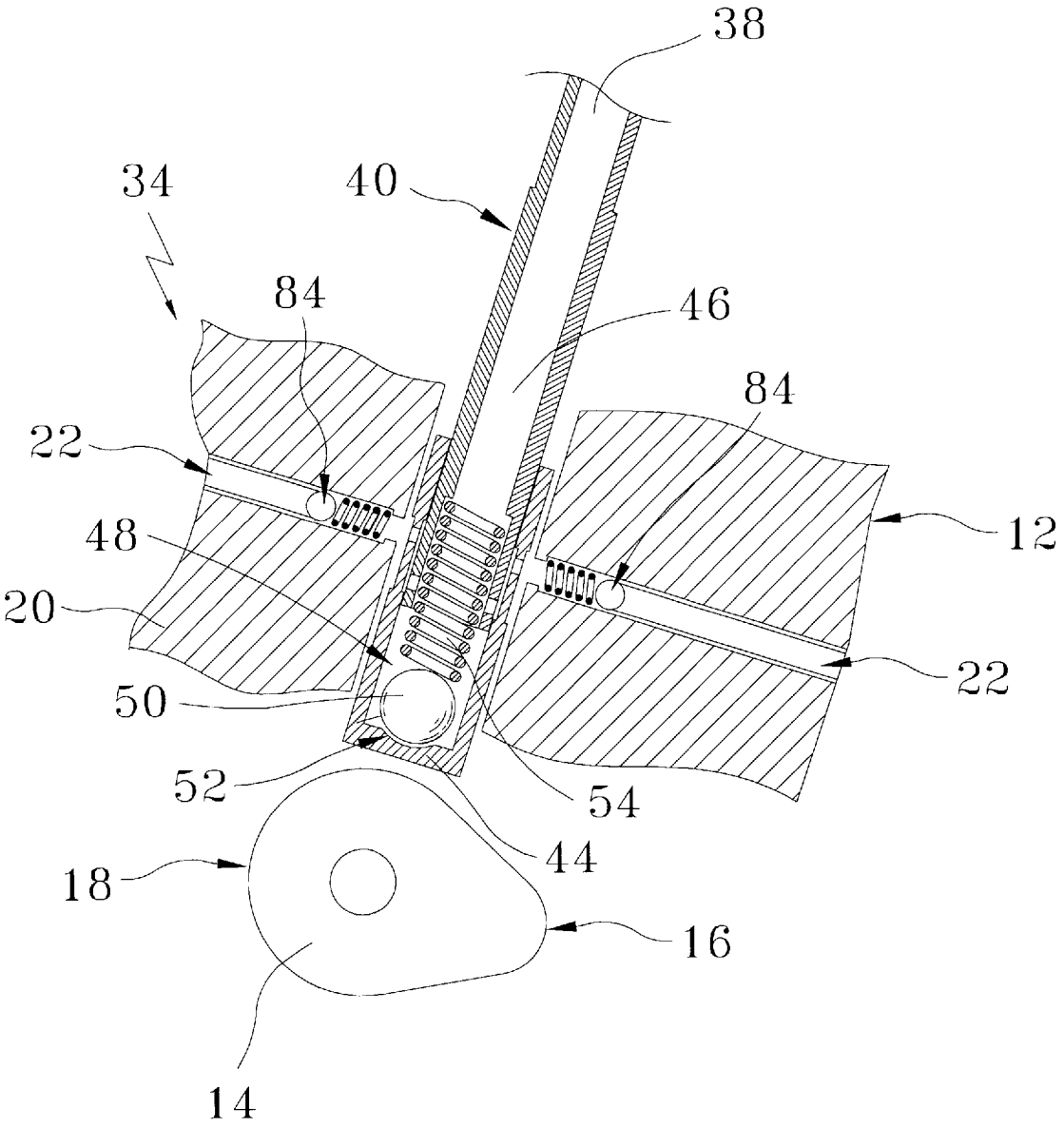
FIG. 2 is an enlarged cross-sectional view of the primary assembly of the invention shown in FIG. 1.

With reference to the figures where like elements have been given like numerical designations to facilitate the reader's understanding of the present invention, and particularly with reference to the embodiment of the present invention illustrated in FIGS. 1 through 4, the preferred embodiment of the present invention is set forth below. The valve control mechanism, designated generally as 10, is installed in the typical internal combustion engine 12 in place of the valve lifter, push rod and rocker arm assembly. The present invention utilizes the standard internal combustion engine cam 14, which has a cam lobe 16 on one side and a cam heel 18 on the opposite side. The valve control mechanism 10 attaches to the cylinder block 20 and cylinder head 21. Engine oil for use as the hydraulic fluid in the present invention is supplied to the valve control mechanism 10 via the engine's oil galley 22. The present invention controls the movement of the intake and/or exhaust valves, shown as 24 in FIGS. 1 and 4. Valve 24 comprises a valve stem 26 and a valve head 27. During operation, the valve head 27 closes against valve seat 28 by the upward force exerted by valve spring 30 and the effect of the combustion gases created in the engine piston chamber. A valve spring retainer 32 attaches to valve stem 26 and abuts against one end of valve spring 30.

The valve control mechanism 10 primarily comprises a primary assembly 34, a secondary assembly 36 and a flow passage 38 interconnecting the two assemblies. Flow passage 38 has a first end 40 and a second end 42, at which are located the primary 34 and secondary 36 assemblies, respectively. Flow passage 38 can be a tube member, a high pressure hydraulic line or a passageway in a molded or formed housing. Flow passage 38 must be made of material that can withstand the relatively high pressures (i.e., 3200 psi or greater range) that can occur during operation of the valve control assembly 10. The actual amount of pressure inside flow passage 38 is dependant upon the amount of resistence from valve spring 30, as the pressure in the system must be sufficient to overcome the valve spring force.

Figure 5:
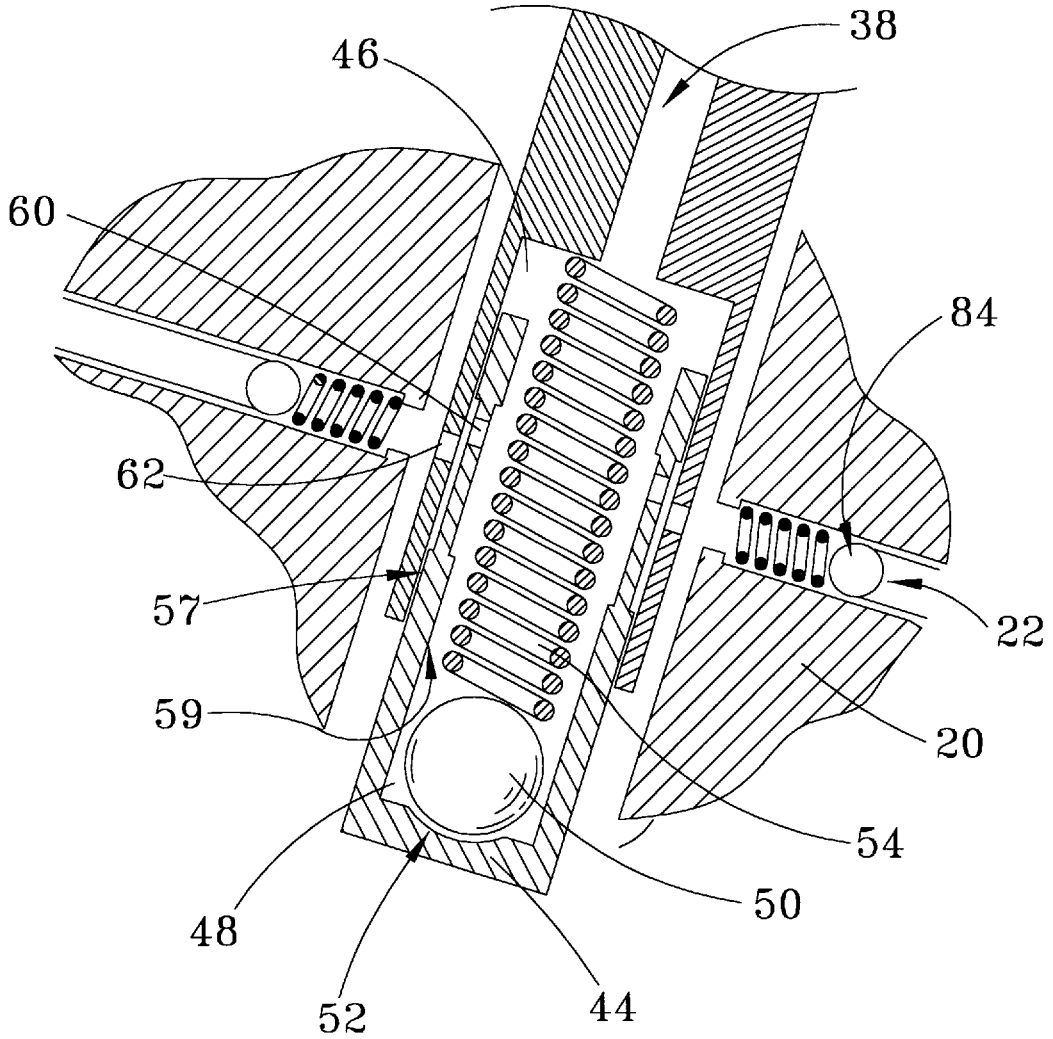
FIG. 5 is an enlarged cross-sectional view of the embodiment of the present invention utilizing an internal primary piston.

The primary assembly 34 has a primary piston 44 and a primary cylinder 46. Primary cylinder 46 can be integral with flow passage 38 or be a separate component that attaches to the first end 40 of flow passage 38. In the preferred embodiment shown in FIGS. 1 through 3, the primary piston 44 is an inverted (external) piston, in that primary cylinder 46 is slidably received in chamber 48 formed inside primary piston 44. The use of an inverted piston as the primary piston 44 provides improved performance because it will deliver more volume of fluid, and therefore pressure, in the same limited space as a piston that goes inside primary cylinder 46. However, as an alternative, the diameter of primary piston 44 could be smaller than and slidably received in primary cylinder 46, as shown in FIG. 5. In the preferred embodiment, a ball bearing 50 on seat 52 is disposed within chamber 48 and a primary spring 54 is disposed between the ball bearing 50 and primary cylinder 46. Ball bearing 50 inside chamber 48 allows primary piston 44 to rotate, thereby reducing wear and increasing the operating life primary piston 44, primary cylinder 46 and primary spring 54. The primary spring 54 provides improved downward action for the primary piston 44 and ensures it maintains contact with cam 14.

Figure 3:
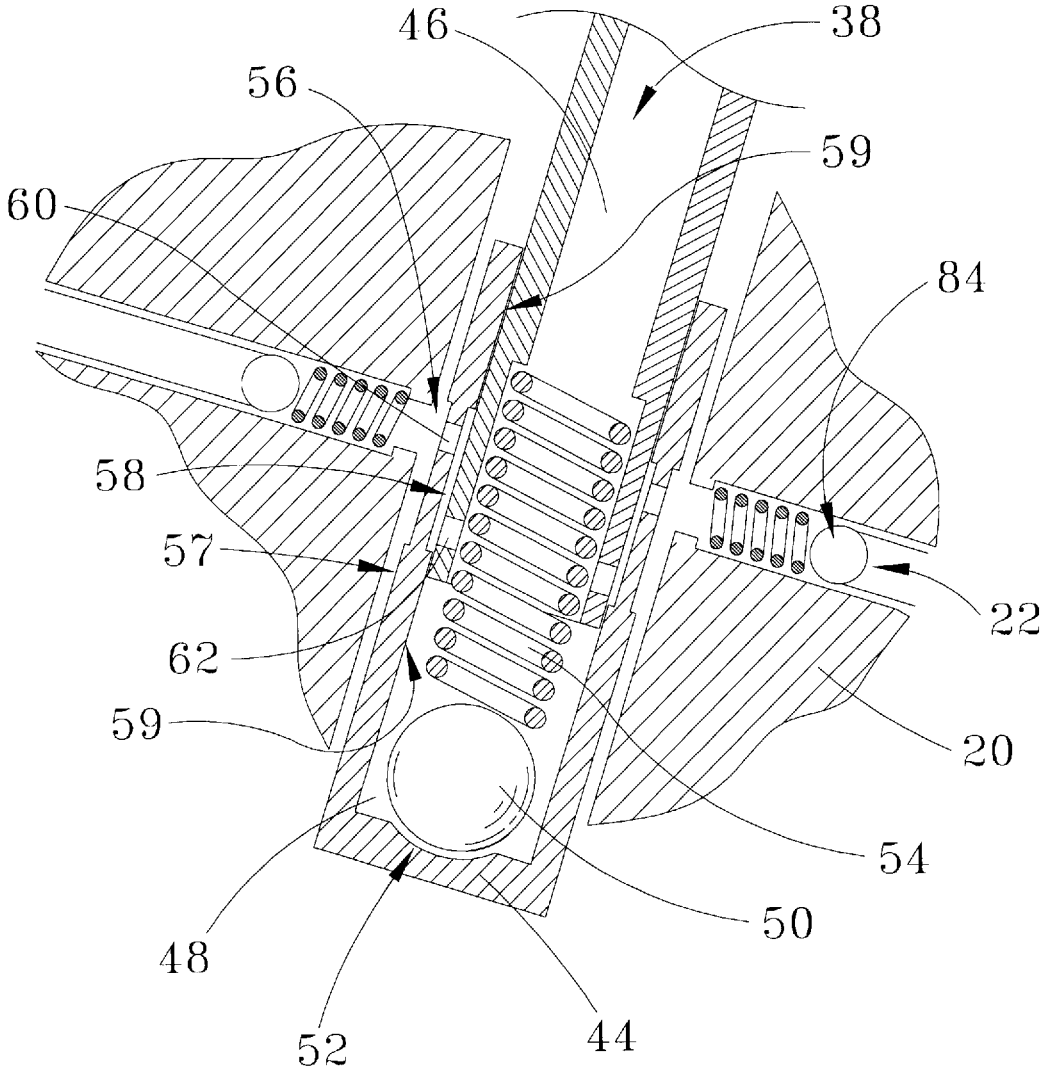
FIG. 3 is an enlarged cross-sectional view of the primary piston of the invention shown in FIGS. 1 and 2.

As best shown in FIG. 3, primary piston 44 should have an external channel 56 on its outer surface 57 and an internal channel 58 on its inner surface 59. Because primary piston 44 rotates freely with ball bearing 50, channels 56 and 58 should circumvent outer surface 57 and inner surface 59, respectively. To facilitate flow of engine oil from oil galley 22 to internal channel 58 and then inside flow passage 38, the primary piston 44 should comprise one or more openings 60, such as holes, slots or the like, interconnecting external channel 56 and internal channel 58. By circumventing outer surface 57, external channel 56 remains in fluid communication with oil galley 22 during the entire primary piston 44 cycle. Oil from oil galley 22 flows into external channel 56 and through opening 60 into internal channel 58, which acts as a temporary storage of oil for flow passage 38 to ensure a sufficient amount of oil is in flow passage 38 at all times to obtain static hydraulic lock.

To improve the flow of oil from internal channel 58 to flow passage 38, primary cylinder 46 (which can comprise or be at the first end 40 of flow passage 38) can have one or more cylinder openings 62. Although cylinder openings 62 can be any shape, the preferred shape is a rectangular slot, which provides a full sized width opening for quicker oil delivery as the slot moves adjacent to the internal channel 58 (as set forth below).

Figure 4:
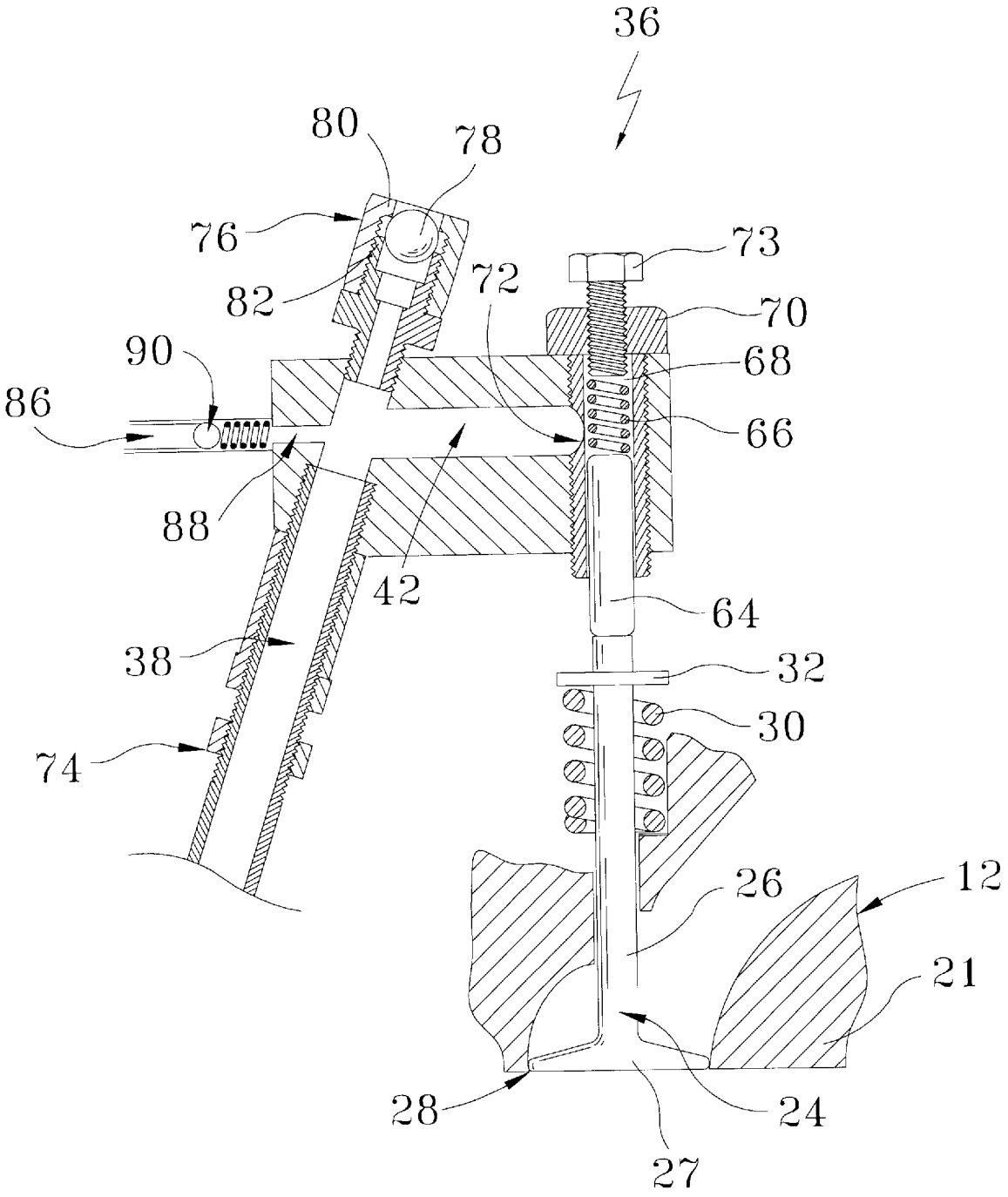
FIG. 4 is an enlarged cross-sectional view of the secondary assembly of the invention shown in FIG. 1.

The secondary assembly 36, located over valve 24, primarily comprises a secondary piston 64 and secondary spring 66 inside secondary cylinder 68. Secondary cylinder 68 can be an integral part of the second end 42 of flow passage 38 or it can comprise a separate component attached to second end 42 of flow passage 38. Secondary piston 64 is moveably disposed inside secondary cylinder 68 and arranged so as to be axially aligned with valve 24 and abut the end of valve stem 26, as shown in FIGS. 1 and 4. Alternatively, valve 24 having a longer valve stem 26 can be utilized to eliminate secondary piston 64 as a separate component. In the alternative configuration, the end of valve stem 26 opposite valve head 27 functions as the secondary piston 64. Although the use of valve stem 26 as the secondary piston 64 beneficially eliminates a separate component, it limits the ability of the user to easily change secondary piston 64 size to obtain a different valve event for a different use (as set forth in the discussion below). Secondary spring 66 is also moveably disposed in the secondary cylinder 68, engaging secondary piston 64 so as to be biasing secondary piston 64 into the end of valve stem 26 to maintain control of secondary piston 64 when leakdown, bleed-back or bleed-off occurs. If desired, secondary spring 66 can be eliminated from secondary assembly 36.

In the preferred embodiment, a snubber assembly 70 is used at second end 42 of flow passage 38 to form secondary cylinder 68. Snubber assembly 70 must have a snubber assembly opening 72 in fluid flow communication with oil passage 38 to allow pressurized oil to flow to secondary piston 64, which is slidably received in snubber assembly 70. Snubber assembly 70 can further comprise a travel limiter 73 to prevent full upward movement of secondary piston 64. As illustrated in FIGS. 1 and 4, snubber assembly 70 can comprise an easily replaceable hollowed-out bolt, which is threadably received in secondary assembly 36, or other removable devices. Use of snubber assembly 70 allows the user to quickly replace secondary piston 64 and secondary cylinder 68 with larger or smaller size units in order to vary the valve event produced from valve control assembly 10 to obtain performance that more matches his or her need (i.e., racing versus street driving).

The ratio of the size of the primary piston 44 to the size of the secondary piston 64 affects the valve event by changing the ratio of cam lobe lift to valve lift. Increasing the relative size of the primary piston 44 proportionally increases the pressure delivered to the secondary piston 64, thereby increasing the distance the secondary piston 64 and valve 24 move, which changes the horsepower and fuel consumption at all engine speeds. The ratio between the diameter of primary 44 and secondary 64 pistons results in much quicker valve events than can be achieved mechanically. For highest efficiency values, the diameter of secondary piston 64 must be less than the diameter of oil passage 38. The ratio between primary piston 44 and secondary piston 64 also effects the amount of pressure inside flow passage 38 (along with the valve spring force). The valve control mechanism 10 allows lower valve spring pressure due to the lower weight to move (i.e., without the lifter, push rod and rocker arm) and an increase in the ratio of valve lift to cam lobe lift over what is achievable with the typical rocker arm assembly.

The operation of the hydraulically operated variable valve control mechanism 10 of the present invention is described below on the basis of an operating cycle beginning with the valve 24 in a closed condition.

With valve 24 in its closed position, the camshaft rotates cam lobe 16 under primary piston 44 to push it upward, causing ball bearing 50 to compress primary spring 54. The upward movement of primary piston 44 pressurizes the oil in chamber 48 and flow passage 38. Cylinder opening 62 starts above the bottom lip of internal channel 58, which is in fluid flow communication with oil galley 22. As the primary piston 44 moves upward, cylinder opening 62 is closed off from communication with oil galley 22, resulting in static hydraulic lock. After obtaining static hydraulic lock, continued upward movement of primary piston 44 further pressurizes the oil in flow passage 38 to place downward pressure on secondary piston 64. Secondary piston 64 is forced downward against the end of the valve stem 26 to compress the valve spring 30 and force valve 24 off of seat 28, thereby opening valve 24 for intake of fuel/air mixture or exhaust of combustion gases. As the cam lobe 16 rotates past the primary assembly 34, the primary piston 44 moves downward, relieving the pressure inside flow passage 38 and reducing the downward force on secondary piston 64, thereby permitting valve 24 to move in an upward and closing direction towards valve seat 28. As the primary piston 44 moves downward, cylinder opening 62 becomes in fluid communication with oil galley 22 and oil can flow into chamber 48 to replace oil lost around the primary 44 and secondary 64 pistons. The first end 40 of flow passage 38, or the bottom of primary cylinder 46, should remain below the lower edge of internal channel 58 during the entire primary piston 44 cycle to maintain alignment in primary piston 44 and avoid undesirable rocking motion.

As configured above, the valve control assembly 10 of the present invention is self-adjusting by operating at zero valve lash (zero clearance between primary piston 44 and cam 14 and zero clearance between secondary piston 64 and valve stem 26). The assembly 10 is also self-lubricating, such that nothing moves until it has oil, thereby preventing dry (non-lubricated) starts. Any air that becomes entrapped in the system will be able to bleed out past the clearances between the primary 44 and secondary 64 pistons and their respective cylinders. Clearances between the pistons and cylinder walls of between 0.0005 and 0.001 have been found to be adequate to bleed out any entrapped air and maintain the ability to achieve the pressure inside the system to obtain the desired results. Many different materials can be used for the various components of the valve control mechanism 10, however, dimensional stability, expansion coefficient and lubrication compatibility between all components is essential to maintain clearances and moveability of the components at all temperatures and viscosities. Materials can be selected to allow more or less bleed-off, depending on the relative expansion coefficients of the materials. With properly selected materials, as the temperature rises and the oil becomes more viscous, the materials can expand to reduce the amount of oil that is bled-off.

To further facilitate modification of engine performance through replacement of secondary assembly 36, the secondary assembly 36 can removably connect to cylinder head 21 and valve control assembly 10. The secondary assembly 36 can be a multiple-piece assembly that is removable from the engine and valve control assembly 10 without having to remove the primary assembly 34. This can be accomplished by having flow passage 38 be two or more separate components that are connected by a flow connection device, such as the adjusting nut mechanism 74 shown in FIGS. 1 and 4, or be locked into place by using a snap-type ring (not shown) or similar device. Use of a multiple-piece assembly also allows the user to modify the valve event, particularly the duration, by raising (which shortens valve duration) or lowering (which lengthens the valve duration) the first end 40 or primary cylinder 46 in chamber 48. Such modification affects when the cylinder opening 62 closes and static hydraulic lock is obtained.

If air entrapment in the control valve assembly 10 is a problem, a fixed or variable orifice flutter air bleeding valve 76 can be used to let air out of the system to ensure that the flow passage can fill with oil while controlling leak down. The user of the valve control assembly 10 can also modify engine performance by changing the size of the flutter valve 76. Changing the size of ball 78 in flutter valve 76 affects the distance ball 78 travels and the clearance between it and the inner wall of flutter valve 76, which will directly affect when static hydraulic lock takes place and the ensuing valve event. The amount of time that flutter valve 76 is open will determine how much oil and air bleeds off. Furthermore, as long as flutter valve 76 is open, there will not be any static hydraulic lock. In addition to flutter valve 76, other types of fixed or variable orifice valves can be utilized to obtain the bleed-off benefits of flutter valve 76. Flutter valve 76 should utilize first flutter seat 80 at the top of valve 76 and a second flutter seat 82. Second flutter seat 82 should be non-sealing (i.e., by being scalloped-shaped or other non-smooth shape) to prevent ball 78 from completely seating on second flutter seat 82 to allow fluid (air and oil) to leak around ball 78. The leakage around ball 78 avoids creating a vacuum in the system, which would cause secondary piston 64 to hit snubber assembly 70 or travel limiter 73 with excessive force.

Although the preferred embodiment of the valve control assembly 10 does not utilize or require any O-rings, seals, gaskets, or check valves (as used by the related art devices), which is an important advantage of the present invention 10 over other systems due to the tendency of such components to wear out or fail, they can be used to obtain a closed system. If a closed system is desired, the assembly 10 would have to be provided with a mechanism to cool or refrigerate the flow passage 38 and/or the oil, as oil in a closed system would get very hot. A closed system would also require a separate bleeding mechanism to bleed out any air that becomes trapped in the system, which would cause the system to not function. The control valve assembly 10 can also utilize check valves 84 in oil galley 22 to ensure upward movement of primary piston 44 transfers its force to pressurizing the oil in flow passage 38 and eliminate total leak down when the engine 12 is not in use. If needed to input oil into the control valve assembly 10, an additional oil galley 86 can be provided with a passageway 88 that interconnects flow passage 38 with the additional oil galley 86. The additional oil galley 86 will fill the system quicker, which will be a benefit at engine start-up. A check valve 90 will be necessary to prevent pressurized oil from flowing up oil galley 86 and to prevent total leak down when the engine 12 is not in use. Although not shown in the accompanying drawings, the control valve assembly 10 can further comprise a pressure relief or regulator in the system to limit the amount of pressure available for valve lift, which will limit the total amount of valve lift. The pressure relief or regulator can be a check valve interconnected to flow passage 38 that is set to open at a pre-determined pressure level.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A hydraulic variable valve control mechanism for operating a valve in an internal combustion engine, comprising:

a fluid supply source;

a primary assembly hydraulically connected to said fluid supply source, said primary assembly having a primary piston and a primary cylinder, said primary piston in operative engagement with a cam in said internal combustion engine;

a ball bearing disposed between said primary piston and said primary cylinder;

primary spring means disposed between said primary cylinder and said ball for biasing said primary piston into engagement with said cam;

a secondary assembly, said secondary assembly having a secondary piston and a secondary cylinder, said secondary piston being in engagement with said valve so as to open or close said valve at the appropriate sequence in the operation of said internal combustion engine; and a flow passage interconnecting said primary assembly and said secondary assembly, said flow passage having a first end and a second end, said primary assembly at said first end of said flow passage and said secondary assembly at said second end of said flow passage, said flow passage in fluid flow communication with said primary and said secondary assemblies, wherein the rotating motion of said cam inside said internal combustion engine causes said primary piston to pressurize the fluid from said fluid supply source in said flow passage to cause said secondary piston to open said valve.

2. The mechanism according to claim 1, wherein said first end of said flow passage forms said primary cylinder.

3. The mechanism according to claim 1 further comprising one or more openings in said primary piston, said one or more openings providing fluid flow communication between said primary assembly and said fluid supply source.

4. The mechanism according to claim 1, wherein said fluid supply source is oil from said internal combustion engine.

5. The mechanism according to claim 1 further comprising one or more cylinder openings in said primary cylinder.

6. The mechanism according to claim 5, wherein said one or more cylinder openings is a substantially rectangular slot.

7. The mechanism according to claim 1 further comprising an orifice valve in fluid flow communication with said flow passage.

8. The mechanism according to claim 7, wherein said orifice valve is a flutter valve having a first flutter seat and a second flutter seat, said second flutter seat being a non-sealing seat.

9. The mechanism according to claim 1, wherein said primary piston is moveably disposed in said primary cylinder.

10. The mechanism according to claim 1, wherein said primary piston is an inverted piston, said inverted piston forming a chamber, said primary cylinder slidably received within said chamber.

11. The mechanism according to claim 10 further comprising an annular space between said inverted piston and said primary cylinder, said annular space sized to allow leakage of fluid through said annular space.

12. The mechanism according to claim 1, wherein said flow passage comprises at least two separate passageways interconnected by at least one flow connection means.

13. The mechanism according to claim 1 further comprising an external channel on the outer surface of said primary piston and an internal channel on the inner surface of said primary piston.

14. The mechanism according to claim 13 further comprising one or more openings in said primary piston, said one or more openings interconnecting said external channel and said internal channel.

15. The mechanism according to claim 13, wherein the bottom of said primary cylinder remains below said internal channel during operation of said valve control mechanism.

16. The mechanism according to claim 1, wherein said secondary piston is axially aligned with said valve.

17. The mechanism according to claim 1 further comprising a secondary spring means disposed in said secondary cylinder for biasing said secondary piston into engagement with said valve.

18. The mechanism according to claim 1 further comprising a removable snubber assembly, said snubber assembly comprising said secondary cylinder, said secondary piston moveably disposed within said snubber assembly.

19. The mechanism according to claim 1, wherein said secondary piston is a stem end of said valve.

20. A hydraulic variable valve control mechanism for operating a valve in an internal combustion engine, comprising:

a primary assembly hydraulically connected to a supply of oil in said internal combustion engine, said primary assembly having a primary piston and a primary cylinder, said primary piston being an inverted piston forming a chamber, said primary cylinder slidably received within said chamber, said primary piston in operative engagement with a cam in said internal combustion engine;

a ball bearing disposed in said chamber between said primary piston and said primary cylinder, said ball bearing allowing free rotation of said primary piston relative to said primary cylinder during operation of said hydraulic valve mechanism;

primary spring means disposed in said chamber between said primary cylinder and said ball bearing for biasing said primary piston into engagement with said cam;

a secondary assembly, said secondary assembly having a secondary piston and a secondary cylinder, said secondary piston axially aligned with said valve, said secondary piston being in engagement with said valve so as to open or close said valve at the appropriate sequence in the operation of said internal combustion engine; and a flow passage interconnecting said primary assembly and said secondary assembly, said flow passage having a first end and a second end, said primary assembly at said first end of said flow passage and said secondary assembly at said second end of said flow passage, said flow passage in fluid flow communication with said primary and said secondary assemblies.

21. The mechanism according to claim 20 further comprising one or more cylinder openings in said primary cylinder.

22. The mechanism according to claim 20 further comprising an external channel on the outer surface of said primary piston, an internal channel on the inner surface of said primary piston and one or more openings in said primary piston interconnecting said external channel and said internal channel.

23. The mechanism according to claim 22, wherein the bottom of said primary cylinder remains below said internal channel during operation of said valve control mechanism.

24. The mechanism according to claim 20 further comprising a secondary spring means disposed between said secondary cylinder and said secondary piston for biasing said secondary piston into engagement with said valve.

25. The mechanism according to claim 20 further comprising a removable snubber assembly, said snubber assembly comprising said secondary cylinder, said secondary piston moveably disposed within said snubber assembly.

26. A hydraulic variable valve control mechanism for operating a valve in an internal combustion engine, comprising:

a primary assembly hydraulically connected to a supply of oil in said internal combustion engine, said primary assembly having a primary piston and a primary cylinder, said primary piston being an inverted piston forming a chamber, said primary cylinder slidably received within said chamber, said primary piston in operative engagement with a cam in said internal combustion engine;

an external channel on the outer surface of said primary piston;

an internal channel on the inner surface of said primary piston;

one or more openings in said primary piston interconnecting said external channel and said internal channel;

a ball bearing disposed in said chamber between said primary piston and said primary cylinder, said ball bearing allowing free rotation of said primary piston relative to said primary cylinder during operation of said hydraulic valve mechanism;

primary spring means disposed in said chamber between said primary cylinder and said ball bearing for biasing said primary piston into engagement with said cam;

a secondary assembly, said secondary assembly having a secondary piston and a secondary cylinder, said secondary piston axially aligned with said valve, said secondary piston being in engagement with said valve so as to open or close said valve at the appropriate sequence in the operation of said internal combustion engine; and a flow passage interconnecting said primary assembly and said secondary assembly, said flow passage having a first end and a second end, said primary assembly at said first end of said flow passage and said secondary assembly at said second end of said flow passage, said flow passage in fluid flow communication with said primary and said secondary assemblies.

27. The mechanism according to claim 26 further comprising one or more cylinder openings in said primary cylinder.

28. The mechanism according to claim 26, wherein the bottom of said primary cylinder remains below said internal channel during operation of said valve control mechanism.

29. The mechanism according to claim 26 further comprising a secondary means disposed between said secondary cylinder and said secondary piston for biasing said secondary piston into engagement with said valve.

* * * * *